United States Patent [19]

Schierling et al.

[11] Patent Number: 4,807,573

[45] Date of Patent: Feb. 28, 1989

[54] FUEL INJECTION ARRANGEMENT FOR A TWO-STROKE ENGINE

[75] Inventors: Roland Schierling, Affalterbach; Werner Geyer, Waiblingen; Michael Wissmann, Schorndorf-Weiler; Hans Nickel, Cottenweiler, all of Fed. Rep. of Germany

[73] Assignee: Andreas Stihl, Waiblingen, Fed. Rep. of Germany

[21] Appl. No.: 202,817

[22] Filed: Jun. 6, 1988

[30] Foreign Application Priority Data

Aug. 15, 1987 [DE] Fed. Rep. of Germany ..... 3727268
Apr. 19, 1988 [DE] Fed. Rep. of Germany ..... 3812949

[51] Int. Cl.[4] ..... F02M 37/04; F02M 59/20

[52] U.S. Cl. ..... 123/73 C; 123/496; 417/395

[58] Field of Search ..... 123/73 B, 73 C, 73 A, 123/73 AD, 496, 387; 417/213, 214, 380, 395

[56] References Cited

U.S. PATENT DOCUMENTS

| | | | |
|---|---|---|---|
| 3,765,802 | 10/1973 | Lettermann et al. | 417/395 |
| 3,913,551 | 10/1975 | Shaver | 123/73 AD |
| 4,300,509 | 11/1981 | Schechter | 123/504 |
| 4,551,076 | 11/1985 | DuBois | 417/395 |
| 4,552,101 | 11/1985 | Borst et al. | 427/395 |
| 4,627,390 | 12/1986 | Antoine | 123/73 CB |
| 4,700,668 | 10/1987 | Schierling et al. | 123/73 C |

FOREIGN PATENT DOCUMENTS

| | | | |
|---|---|---|---|
| 1325670 | 3/1963 | France | 417/395 |
| 8156 | of 1910 | United Kingdom | 123/504 |

*Primary Examiner*—David A. Okonsky
*Attorney, Agent, or Firm*—Walter Ottesen

[57] ABSTRACT

The invention is directed to a fuel injection arrangement for two-stroke engines for portable tools such as motor-driven saws. In known fuel-injecting arrangements, the injection pump is driven by the pressure of the crankcase. The crankcase pressure increases up to a maximum value which remains constant starting with a predetermined rotational speed up to and including the maximum rotational speed. When the peak pressure of the crankcase is constant, the stroke of the pump piston of the injection pump is also constant and so is the quantity of fuel which is pumped. However, at higher speeds where the speed is increasing because of throttling in the air intake channel, the air charge of the cylinder reduces and an overrich mixture is formed. The fuel injection arrangement of the invention provides for an automatic reduction in the quantity of fuel injected at high and at the highest speeds. For adapting the required quantity of fuel at high speeds, a counterpressure is developed in the return chamber of the injection pump in dependence upon speed whereby the stroke of the pump piston is reduced. In this way, a corresponding reduction of the pumped quantity of fuel is achieved.

28 Claims, 6 Drawing Sheets

FUEL INJECTION ARRANGEMENT FOR A TWO-STROKE ENGINE

FIELD OF THE INVENTION

The invention relates to a fuel injection arrangement for a two-stroke engine, especially for handheld portable tools such as motor-driven saws or the like. The fuel injection arrangement includes an injection pump and an injection nozzle communicating with the combustion chamber of the two-stroke engine. A pump chamber of the fuel-injection pump is partitioned into a pulse chamber and a return chamber by a membrane which actuates the pump piston. The pulse chamber is connected with the crankcase for charging the pulse chamber with the pressure present in the crankcase.

BACKGROUND OF THE INVENTION

A fuel injection arrangement of the above type is disclosed in U.S. Pat. No. 4,700,668. The pulse chamber is charged directly with the pressure present in the crankcase while the return chamber communicates with the atmosphere. The pump piston is moved up and down in correspondence to the pressure variations in the crankcase and injects fuel into the combustion chamber of the two-stroke engine.

The pressure in the crankcase is dependent upon the rotational speed and load of the two-stroke engine. An overpressure develops with a downward movement of the piston in the direction toward bottom dead center; whereas, the pressure in the crankcase drops to an underpressure with the following upward movement of the piston toward top dead center. The crankcase pressure then swings between positive and negative values with the positive values likewise increasing to a maximum with increasing speed which then remain constant up to the highest speed. The pressure oscillations lie, for example, between approximately 0.75 bar and −0.2 bar.

In U.S. Pat. No. 4,700,668, it is suggested that a controllable pilot valve arranged between the crankcase and the pulse chamber be provided for adapting the beginning of the injection in dependence upon the rotational speed by utilizing the pressure conditions in the crankcase. At high rpm, a later injection point is obtained whereas at lower rpm, an earlier injection point is obtained.

By changing the time point of injection in this manner, the quantity of injected fuel however remains substantially unchanged so that the mixture becomes too rich at high rpm because of the changed air charge of the cylinder. In order to counter the formation of an overrich mixture, a throttle is placed in the connecting line from the crankcase to the pulse chamber which is effective at high rpm. This measure by itself is not adequate to adapt the quantity of fuel with sufficient precision to the rpm.

SUMMARY OF THE INVENTION

It is an object of the invention to improve upon the fuel injection arrangement described above in such a manner that the quantity of fuel is adapted to correspond to the quantity of air drawn in and to achieve this adaptation by simple means. It is a further object of the invention to cause the quantity of fuel adapted to the rpm to be injected at high injection pressure by a substantial utilization of the crankcase pressure.

The fuel injection arrangement of the invention is for a two-stroke engine, especially for handheld portable tools such as motor-driven saws or the like. The engine has a piston and a cylinder conjointly defining a combustion chamber and has a crankcase wherein pressure is developed in response to the movement of the piston. The fuel injection arrangement of the invention includes: an injection nozzle for injecting fuel into the combustion chamber; a fuel injection pump including a housing defining an enclosed work space and a membrane partitioning the work space into a pulse chamber and a return chamber; a connecting line connecting the pulse chamber to the crankcase for charging the pulse chamber with the pressure present in the crankcase for actuating the membrane to develop an actuating force; the fuel injection pump further including pumping means for pumping fuel to the injection nozzle and the pumping means including a piston operatively connected to the membrane so as to be reciprocally movable through a piston stroke; and, counterpressure means for generating a counterpressure in the return chamber for changing the piston stroke in dependence upon the rotational speed of the engine thereby changing the quantity of fuel pumped by the pumping means.

By changing the pressure in the return chamber, the stroke of the pump piston can be effectively changed without utilizing the actuating force effective in the pulse chamber. For example, if the counterpressure in the return chamber is controlled so as to increase rapidly at a high rpm in dependence upon the piston stroke, the counterforce neutralizing the actuating force is reached relatively quickly in the return chamber; that is, after a small piston stroke. The injected quantity of fuel is directly proportional to the piston stroke so that correspondingly less fuel is injected. By controlling the counterpressure in the return chamber pursuant to the invention, a simple adaptation of the quantity of fuel to the reduced air charge of the cylinder is obtained at high rpm because of the throttling operation during air intake.

If the counterpressure is controlled to increase rapidly in the return chamber for limiting the piston stroke at high rpm, the counterpressure is advantageously negatively formed for obtaining a high actuating force at idle and at low rpm. This is obtained in that the negative pressure point in the crankcase i used to evacuate the return chamber so that at idle the following slightly positive pressure point is adequate for a forceful actuation of the pump piston.

The return chamber is advantageously connected to an adjusting volume via an adjusting line with a throttle being provided in the adjusting line for rapidly throttling adjusting flows. In this way, the throttle functions only in the range between increased rpm up to the highest rpm whereby a counterpressure is built up.

If a check valve opening to the return chamber is placed in a bypass to the throttle, then a rapid pressure balance between the adjusting volume and the pressure chamber occurs when the membrane is returned to its initial position. In this way, each piston stroke is begun under the same starting pressure conditions.

An adjusting chamber closed on all sides is preferably made in the form of a bellows having a variable volume. In lieu of this adjusting chamber, the atmosphere can also be advantageously utilized as an adjusting volume. This can provide space advantages especially when tight space conditions are present.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
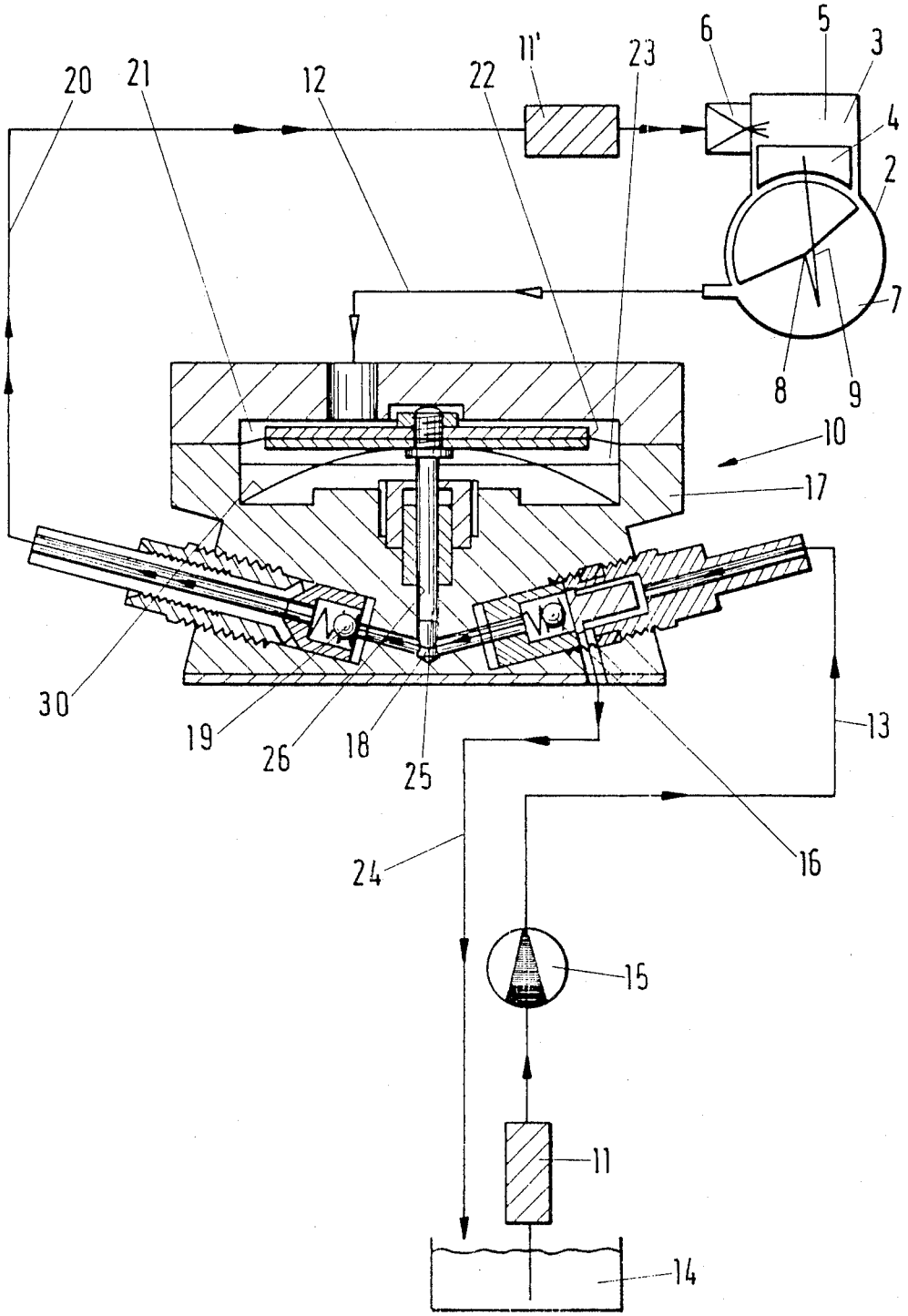
FIG. 1 is a schematic of the fuel-injection arrangement according to the invention with the injection pump shown in section along the axis of the pump piston.

The fuel injection arrangement according to the invention is provided for a two-stroke engine 2 which is especially for handheld portable tools such as a handheld portable motor-driven saw and the like. The two-stroke engine includes a cylinder 3, a piston 4, a combustion chamber 5, a fuel-injection nozzle 6, a crankcase 7 as well as a crankshaft 8 and a connecting rod 9 for the piston 4. The pressure in the crankcase 7 changes with the upward and downward movements of the piston 4 during operation of the two-stroke engine 2. The pressure increases during the downward movement of the piston 4 from top dead center to approximately bottom dead center so that an overpressure develops in the crankcase. This overpressure then drops to an underpressure during the upward movement of the piston 4. The fuel injection arrangement shown in FIG. 1 includes an injection pump 10 having a connecting line 12 which is connected to the crankcase 7 and conducts the pressure present in the crankcase to the fuel injection pump 10. A fuel metering line 13 is connected to the fuel injection pump 10. Fuel is pumped to an intake valve 16 through the fuel metering line 13 via a fuel filter 11 from a tank 14 by means of a feed pump 15. The intake valve 16 is configured as a check valve.

The feed pressure is adjusted so that the intake valve 16 does not open. Fuel which is not drawn by suction is directed back into the tank 14 via the return line 24.

The intake valve 16 is located on one side of a pump chamber 18 built into the housing 17 of the fuel injection pump 10; whereas, an outlet valve 19 is mounted on the opposite side and is likewise configured as a check valve. A fuel injection line 20 runs from this outlet valve 19 via a further fuel filter 11' to the fuel injection nozzle 6 to the two-stroke engine 2.

The connecting line 12 leading away from the crankcase 7 leads to a pulse chamber 21 of the fuel injection pump 10. The pulse chamber 21 is separated from an adjacent return chamber 23 by means of a membrane 22. The pulse chamber 21 and the return chamber 23 conjointly define the drive chamber of the fuel injection pump.

A pump piston 25 is attached to the membrane 22 at the center thereof and is journalled in a guide bore 26 (pump cylinder) of the housing 17 so as to be reciprocally movable in the axial direction. The membrane 22 is biased into its upper initial position (FIGS. 1 and 2) by means of a return spring 30. In order to reduce the movable mass, the membrane plate is configured to have appropriate weight saving cutouts. The membrane plate can, in this way, follow rapid changes in pressure without difficulty.

Figure 2:
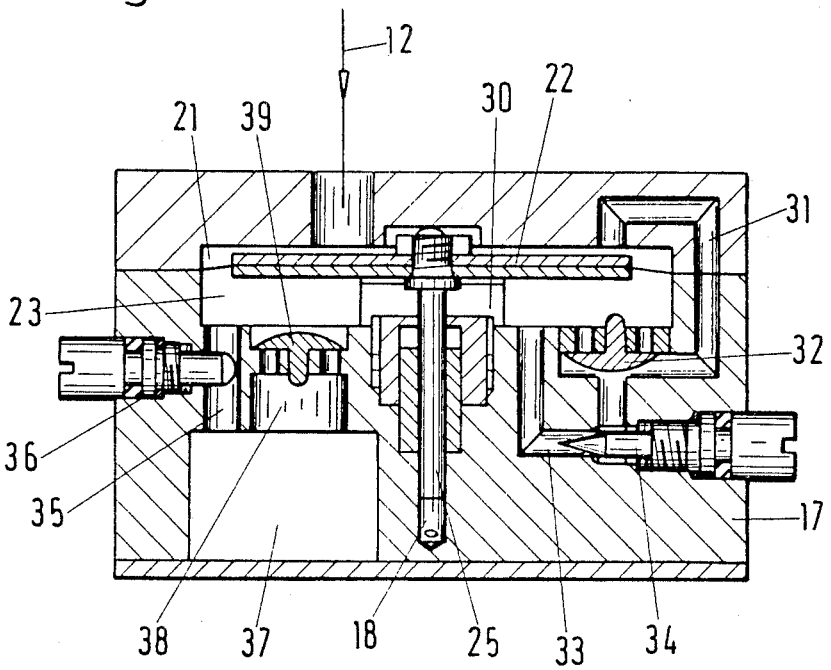
FIG. 2 is a section view of the fuel injection pump again taken through the axis of the pump piston but rotated 90° with respect to the section view shown in FIG. 1.
Figure 3:
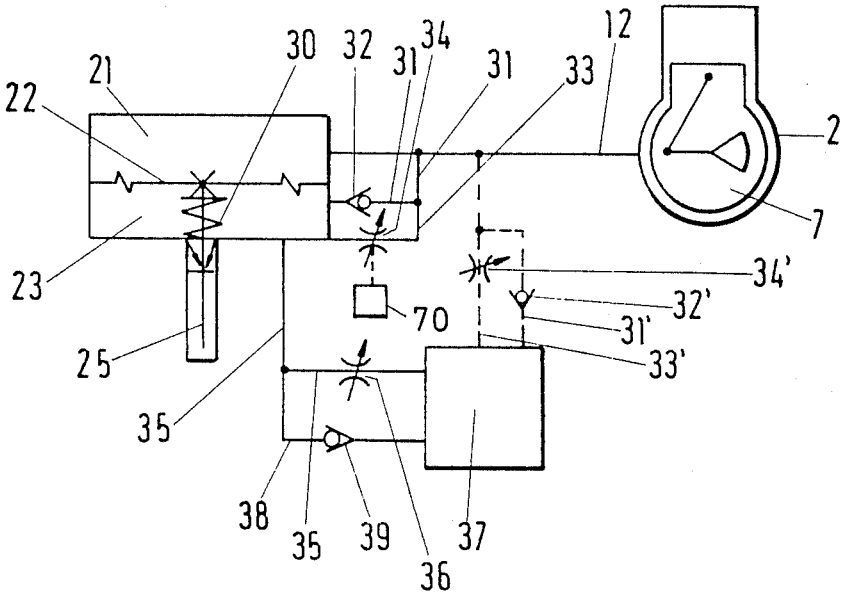
FIG. 3 is a schematic of the fuel injection pump showing the working chamber partitioned into a pulse chamber and a return chamber with the latter being connected to an adjusting volume.

The circuit arrangement of the pulse chamber 21 and the pressure chamber 23 is shown in a section view in FIG. 2 and is illustrated schematically in FIG. 3. A connecting line 31 from the pulse chamber 21 to the return chamber 23 is provided in the housing 17 of the fuel injection pump 10. A check valve 32 is mounted in the connecting line 31 so that it opens toward the pulse chamber 21. A throttle 34 is mounted in the bypass 33 of the check valve, and, as will be described below, is adjusted for slow adjusting operations.

In addition, the return chamber 23 is connected to an adjusting volume 37 via an adjusting line 35. The adjusting volume 37 is shown in the embodiment of FIGS. 2 and 3 as being a rigid chamber closed on all sides. An adjustable throttle 36 is mounted in the adjusting line 35 and a check valve 39 opening into the return chamber 23 is connected into a bypass 38.

The operation of the fuel injection arrangement according to the invention will now be described.

The crankcase pressure is present in the pulse chamber 21 via connecting line 12. The pressure acts upon the membrane plate 22 and actuates the pump piston 25 in the sense of a downward movement (FIG. 2) with the fuel being compressed in the pump chamber 18 and being injected into the combustion chamber 5 of the two-stroke engine 2 via the outlet valve 19 (FIG. 1), the injection line 20 and the injection nozzle 6.

The adjustable throttle 36 is so adjusted that an adjusting flow takes place from the return chamber 23 to the adjusting volume 37 at the initial rpm whereby essentially no counterpressure acting against the actuating force can build up in the return chamber 23.

After the injection of the fuel, the piston 4 moves in the direction of top dead center whereby the pressure in the crankcase drops to an underpressure. The membrane 22 and the pump piston 29 are returned to their rest position (shown in FIG. 1) because of the action of the return spring 30. With the upward movement of the pump piston, fresh fuel under the feed pressure is drawn in by suction via the intake valve 16. The pump chamber then is filled.

If the return chamber 23 is open to the atmosphere, the crankcase pressure increasing with increasing rpm leads to greater quantities of pumped fuel. The crankcase pressure however reaches its maximum value of, for example, 0.75 bar far ahead of the maximum rpm of the two-stroke engine and this crankcase pressure remains constant also with further increasing rpm. Consequently, upon reaching the rpm with maximum crankcase pressure, the quantity of fuel pumped by the injection pump 10 likewise remains constant.

The operation of drawing air in by suction in a two-stroke engine is a throttling operation so that with increasing rpm, the air charge of the cylinder becomes less; however, if a constant quantity of fuel continues to be injected then the fuel/air mixture in the combustion chamber becomes too rich.

In order to inject a quantity of fuel at high rpm which is adapted to the reduced quantities of drawn in air, the fuel injection according to the invention reduces the stroke of the pump piston at increasing rpm. For this purpose, a counterforce effective in the return chamber is built up to counter the actuating force in the pulse chamber with the counterforce being dependent upon the rpm of the two-stroke engine and the stroke of the pump piston (matching of the pump characteristic against rotational speed).

Pursuant to the embodiments shown in FIGS. 2 and 3, the counterpressure is built up in the return chamber 23 in that an adjusting volume 37 is connected with the return chamber 23 via a throttle 36. The throttle 36 is so dimensioned that an unobstructed flow takes place through the adjusting line 35 at idle and low rpm. No high counterpressure develops in the return chamber 23 at idle and low rpm which could affect the stroke of the pump piston 25. The pump piston then pumps in correspondence to the actual pressure present in the crankcase.

If the rpm increases, then the speed of the flow through the adjusting line 35 also increases and the throttle 36 becomes effective. With each working stroke of the pump piston and of the membrane 22, a counterpressure builds up in the return chamber 23. The higher the rpm becomes, the faster the membrane 22 is actuated and the flow velocity in the adjusting line 35 increases. The greater the flow velocity, the greater becomes the effect of the throttle 36 and the greater becomes the counterpressure in the return chamber 23. This counterpressure acts on the membrane 22 and generates a force acting in a direction opposite to the actuating force in the pulse chamber and this force reduces the piston stroke with increasing rpm. In this way, a tapering of the injected quantity of fuel as a function of rpm is obtained in adaptation to the reduction of the quantity of air drawn in.

In order to obtain a most precise adaptation of the quantity of fuel to be pumped, it can be advantageous to readjust the adjustable throttle 36 by means of an electrical positioning device with this device being controlled electronically by a control apparatus which processes the specific combustion data such as temperature, rpm or also the quality of the exhaust gas and the like. In lieu of the throttle 36 shown in FIG. 2 which is proportionally adjustable, it can be advantageous to use a magnetic valve which only makes possible the positions of "adjusting line 35 closed" and "adjusting line 35 open". Such a two-position magnetic valve is controlled via a pulse chain with the clock sequence of the pulses determining the throttle action as a function of time.

In order to have balanced pressure relationships at the beginning of each piston stroke and especially at high rpm, the bypass is provided with a check valve 39 opening in the direction to the return chamber 23. The bypass provides for an unthrottled adjusting flow when the piston pump and the membrane 22 are returned.

Since the crankcase overpressure is only very low at idle and low rpm (for example, approximately 0.1 bar), only a low actuating force is available for the injection pump. However, in order to provide, especially at idle, a complete, quick and forceful injection of the needed quantity of fuel, a connecting line 31 is provided from the pulse chamber 21 to the return chamber 23. If an underpressure is present, then an evacuation of the return chamber occurs via the check valve 32. The check valve 32 closes with a change of the crankcase pressure to a positive pressure value and the positive pressure value then is present exclusively in the pulse chamber 21. Since the return force of the spring 30 is reduced because of the underpressure effective in the return chamber 23, the low crankcase overpressure in the pulse chamber 21 is adequate to displace the pump piston 25 with the required piston stroke. A higher pressure difference for actuating the pump piston 25 is utilized by means of the negative counterpressure in the return chamber 23 with the appearance of the crankcase overpressure.

The bypass 33 with the adjustable throttle 34 is provided for the adjusting flows since the crankcase underpressure can vary with rpm as a function of time. The throttle 34 is so configured that only slow adjusting flows are permitted and therefore the return chamber is compensated to the actual underpressure peak value (for example −0.2 bar) after a few revolutions of the two-stroke engine. This mechanism prevents that very high random underpressure peaks remain stored in the return chamber.

It is also advantageous with the described idle adaptation of the stroke of the pump piston 25 to readjust the adjustable throttle 34 by means of an electrical control arrangement 70 with this readjustment occurring on the basis of operating characteristic data of the two-stroke engine processed by the control arrangement.

As shown by the dashed lines (31' and 33') in FIG. 3, it can be advantageous not to permit the conducting line 31 to open directly into the return chamber 23; instead, to let it open into the adjusting volume 37 configured so as to be closed on all sides. The bypass 33' with the adjusting throttle 34' opens into the adjusting volume 37 in a corresponding manner. A threshold valve 32' is provided in conducting line 31'. The above-described function of the idle adaptation as well as the full-load adaptation of the quantity of fuel remains unchanged since the adjusting line 35 is substantially greater in diameter than the diameter of the bypass 33 or of the adjusting throttle 34.

Figure 3A:
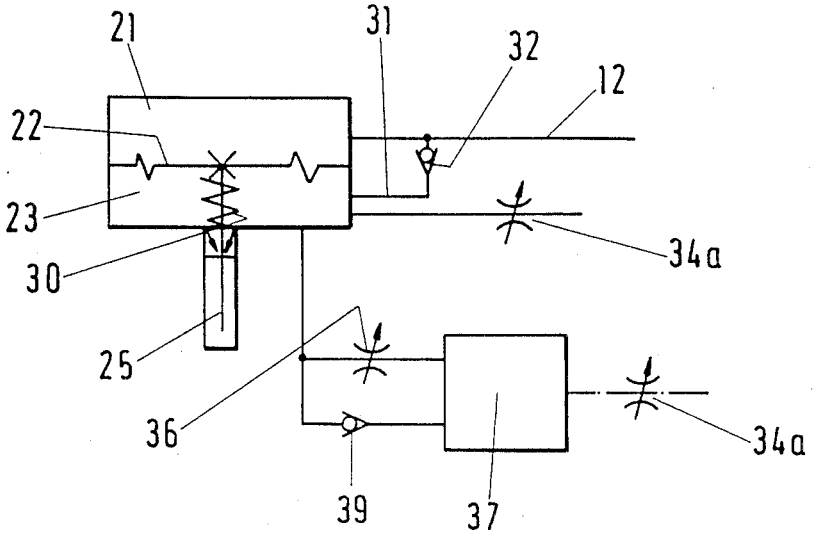
FIG. 3*a* is a schematic of the injection pump shown in FIG. 3 in a first circuit arrangement.
Figure 3B:
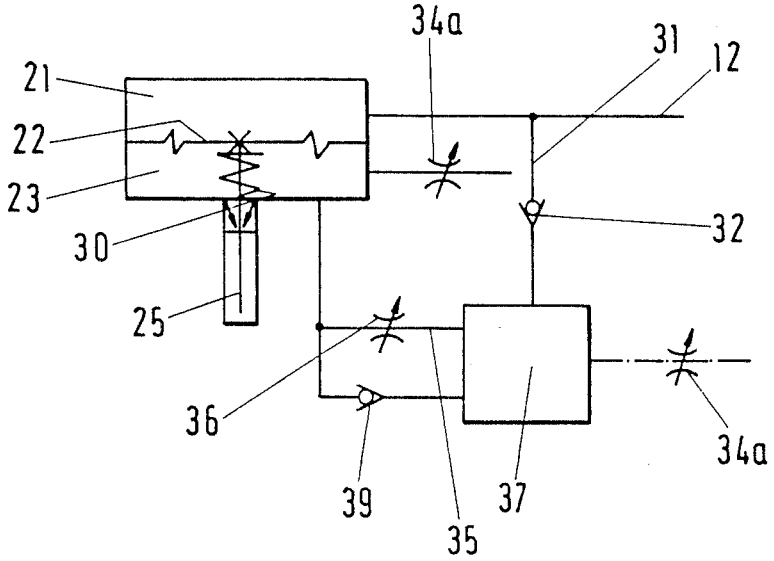
FIG. 3*b* is a schematic of the fuel injection pump of FIG. 3 shown in a second circuit arrangement.
Figure 3C:
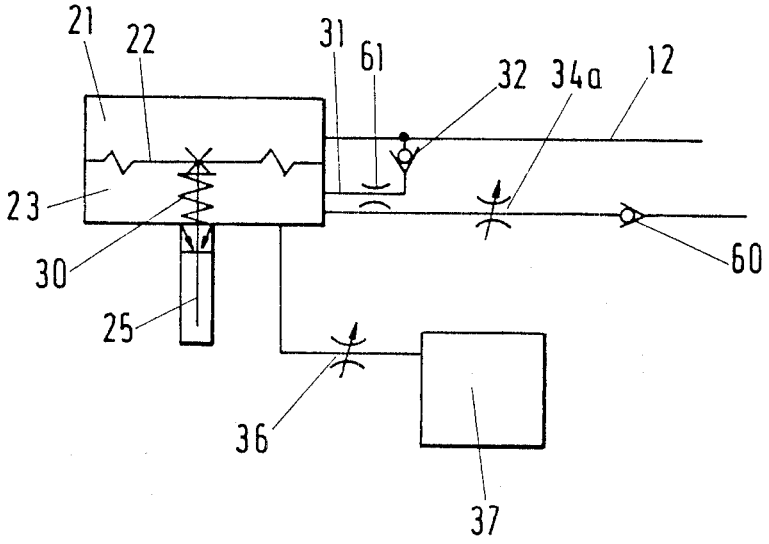
FIG. 3*c* is a schematic of the fuel injection pump of FIG. 3 shown in a third circuit arrangement.

Further circuit arrangement variations for obtaining idle adaptation are shown in FIGS. 3*a* to FIG. 3*c*. In FIG. 3*a*, the connecting line 31 is connected to the check valve 32 at the return chamber 23 with the check valve 32 being provided for the evacuation of the return chamber 23; whereas, the adjusting throttle 34*a*, which is required for the adjusting operation, establishes a connection to the atmosphere. The value of the throttle 34*a* is so provided that only slow adjusting operations are permitted which assure an evacuation of the return chamber 23 to the underpressure peak value in the crankcase. The adjusting throttle 34*a* can also be provided on the adjusting volume 37 in lieu of on the return chamber 23 as shown with the dotted line in FIG. 3*a*. The function of the injection pump according to the invention remains unchanged notwithstanding the changed connection.

In the embodiment of FIG. 3*b*, the connecting line provided for the evacuation is connected with the check valve 32 on the adjusting chamber 37. The throttle 36 in the adjusting line 35 does not block the evacuation since the evacuation of the return chamber 23 is only intended at low rpm. After a few revolutions, the return chamber 23 is evacuated to the peak underpressure of the crankcase. An adjusting throttle 34*a* is connected at the return chamber 23 to compensate for variations of the peak underpressure. It can be advantageous to connect the adjusting throttle 34*a* directly to the adjusting chamber 37 rather than to the return chamber 23.

The embodiment of FIG. 3*c* is similar to that shown in FIG. 3*a*. A throttle 61 is connected in series next to the check valve 32 in the connecting line 31. For this reason, the return chamber 23 is vented at low rpm by the underpressure of the crankcase and an underpressure develops supporting the pump stroke. The throttle 61 increases in effectiveness with increasing rpm and blocks the ventilation and the formation of underpressure. The support of the stroke becomes less and the pump stroke becomes less with increasing rpm.

A check valve 60 is connected in series with the ventilating throttle 34*a* and completely prevents a ventilation of the return chamber 23 to the atmosphere. The volume in the return chamber is compressed and an overpressure occurs at the point in time of the piston stroke (downward moving membrane 22). This overpressure can also not be reduced via the connecting line 31 (throttle 61, check valve 32) because the crankcase pressure driving the membrane 22 is greater at this point in time.

Since with this switching of the return chamber 23 its ventilation is prevented, no underpressure can form at higher rpm so that a stroke support at high rpm is significantly reduced. The pump stroke and the injection quantity therefore become less.

Figure 4:
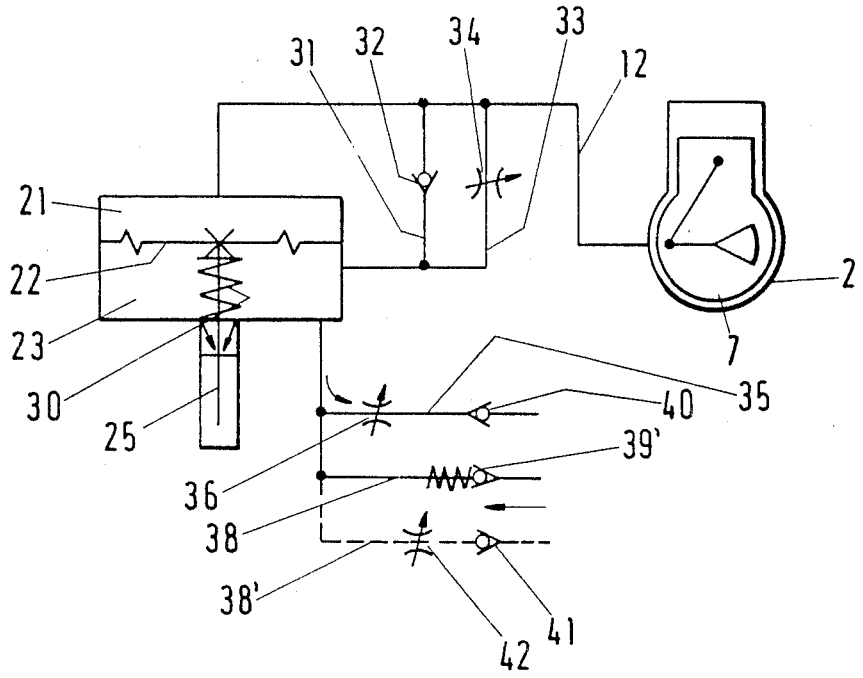
FIG. 4 is a schematic of the arrangement shown in FIG. 3 with a connection to the atmosphere as an adjusting volume.

In the embodiment of FIG. 4, the no-load adaptation as already described occurs by means of connecting line 31 with the check valve 32 and via the bypass 33 with the adjusting throttle 34.

The adjusting line 35 is opened to the atmosphere for a full-load adaptation of the fuel quantity to be pumped. The throughput cross section of the adjusting line 35 is again determined by the throttle 36. In order o ensure in the adjusting line 35 a flow which is exclusively in the sense of a ventilation of the return chamber 23 to the atmosphere, a check valve 40 opening to the atmosphere is connected in series with the throttle 36.

The bypass 38 to the throttle 36 likewise opens to the atmosphere and has a check valve 39' opening to the return chamber 23. The check valve 39' is configured as a pressure-holding valve and opens only after a predetermined pressure threshold value is reached with this threshold pressure value being preferably adjustable. This pressure threshold value is adjusted such that the peak underpressure of the crankcase can build up in the return chamber 23 without the valve 39' opening. Higher underpressures which develop by means of the return stroke of the membrane 22 and pump piston 25 open the valve 39'. In this way, adjusting air flows into the return chamber 23 and the following stroke of the pump piston occurs with the same starting condition. The operation of this circuit arrangement corresponds to that already described above.

As an alternate to the pressure-holding valve 39', a series circuit of an adjustable throttle 42 and a check valve 41 opening to the return chamber 23 can be advantageous. The throttle 42 is so adjusted that only a slow ventilation via the bypass 38' is possible so that the peak underpressure in the chamber 23 can build up over time.

Figure 5:
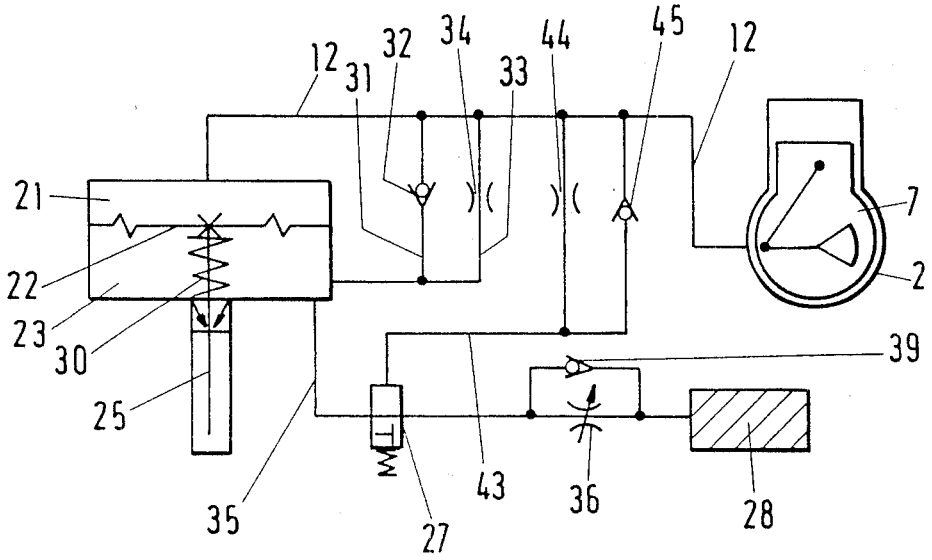
FIG. 5 is a schematic of the arrangement shown in FIG. 4 wherein the line leading to the atmosphere is switched in dependence upon pressure.

In the embodiment of FIG. 5, the idle adaptation is switched as in FIG. 4. For full-load adaptation, the return chamber 23 is connected with the atmosphere via a switchable valve 27, the adjustable throttle 36 and the check valve 39. An air filter 28 can be advantageously mounted in this connection. The valve 27 is a pressure-actuated valve which connects return chamber 23 with the atmosphere starting at a threshold value of, for example, 0.2 bar and, beneath this threshold value, the valve 27 blocks the adjusting line 35. The actuating end of the valve 27 is connected with the connecting line 12 via a pressure line 43 and a check valve 45 opening to the actuating valve. A throttle 44 is provided in the bypass to the check valve 45 and the throttle permits slow adjusting operations.

If the crankcase pressure is above 0.2 bar, that is in the condition under load, the pressure acts on valve 27 via check valve 45 and switches the adjusting line 35 free. The full-load adaptation described above occurs because of the throttle 36 and the check valve 39. As soon as the pressure in the crankcase drops below the threshold value, that is in idle, a pressure compensation occurs via throttle 44 and the valve 27 switches into its blocking position in which the adjusting line 35 is blocked. Now only the idle adaptation by means of the check valve 32 or the adjusting throttle 34 is effective. In this way, idle adaptation and load adaptation can be separated and cannot influence each other.

Figure 6:
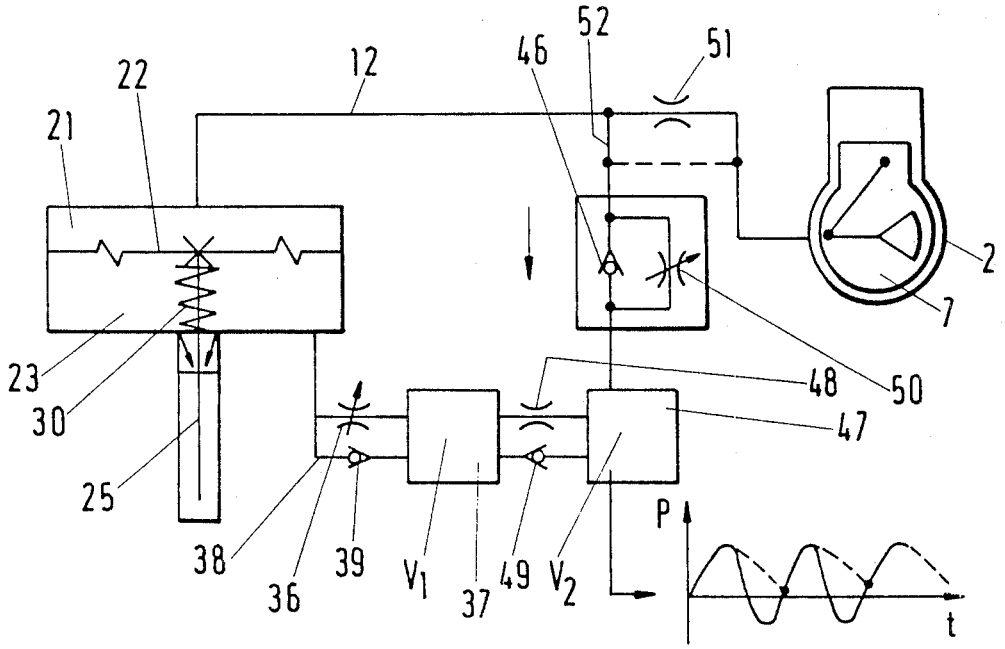
FIG. 6 is a schematic of the fuel injection pump according to FIG. 3 with an average pressure adjustable in the adjusting volume; and, FIG. 7 is a schematic of the fuel injection pump according to the invention wherein the counterpressure in the return chamber is controlled in dependence upon the air intake pressure.

In the embodiment of FIG. 6, the counterpressure in the return chamber 23 and the stroke of the membrane 22 and its speed is determined by the pressure built up in the adjusting volume 37. The adjusting volume, in turn, is connected with the return chamber 23 via the throttle 36 and the check valve 39. Furthermore, the adjusting volume 37 is connected with a storage volume 47 via a throttle 48 and a check valve 49 opening to the storage volume 47. The storage volume 47 is connected via a line 52 with the connecting line 12 after or before (indicated by the dashed line) a throttle 51 provided in the connecting line. A check valve 46 opening into the storage volume 47 is connected into line 52 for which an adjusting throttle 50 is provided in the bypass.

The pressure which builds up in the storage volume 47 is shown in the corresponding diagram. The solid line shows the varying crankcase pressure having positive values which lead directly to a corresponding pressure increase in the storage volume 47 via check valve 46. If the overpressure in the crankcase drops, an adjusting operation begins from the storage volume 47 via an adjustable throttle 50 to connecting line 12. The throttle 50 is so dimensioned that the pressure in the storage volume 47 drops slower than the crankcase pressure as shown by the dotted line so that a pressure is maintained in the storage volume 47 which deviates from the crankcase pressure until a subsequent pressure increase occurs. A varying positive pressure is therefore present in the storage volume 47.

At lower engine rpm, the pressure in the storage volume 47 drops to low pressure values because adequate time is available for the adjusting operation. At no-load, the pressure in the storage volume drops almost to the underpressure in the crankcase. At high rpm, the pressure in the storage volume 47 does not drop off so intensely because less time is available for the adjusting operation. The lowest pressures which can occur in the storage volume 47 are therefore increased with increasing rpm. The highest pressures correspond to those in the crankcase.

The check valve 49 between the adjusting volume 37 and the storage volume 47 limits the pressure in the adjusting volume 37 to the lowest pressure in the storage volume 47. The throttle 48, in turn, effects only slow adjusting operations with rpm changes. A pressure develops in the adjusting volume 37 which corresponds to the lowest pressure in the storage volume 47 and, as the latter, it increases with increasing rpm.

The check valve 39 between the adjusting volume 37 and the return chamber 23 of the injection pump 10 delivers the pressure in the adjusting volume 37 directly to the return chamber and generates there a counterpressure dependent upon rpm. With a suitable configuration, an underpressure develops at idle. This counterpressure in the return chamber which increases with increasing rpm reduces the stroke of the pump piston with increasing rpm. The pumped fuel quantity is therefore adapted to the requirement of the engine. The adjustable throttle 36 functions in an unchanged manner between the return chamber 23 and the adjusting volume 37.

Figure 7:
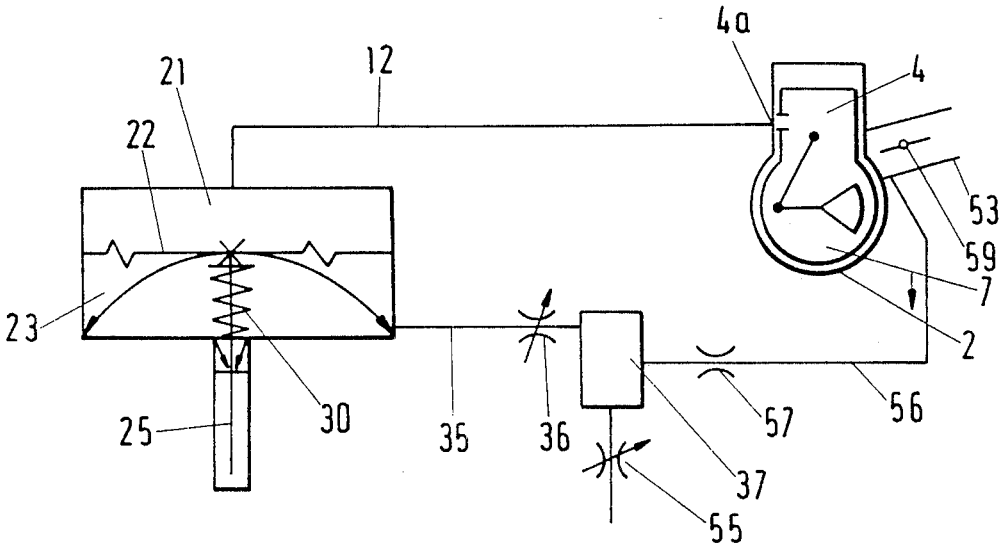

In the embodiment of FIG. 7, the return chamber 23 is connected with the intake pipe 53 of the two-stroke engine via the lines (35 and 56). An adjusting volume 37 is arranged between the underpressure line 56 and the connecting line 35 leading to the return chamber 23. The adjusting volume 37 is connected with the atmosphere via a ventilating throttle 55. The pulse chamber 21 is connected with an opening in the housing of the two-stroke engine via the connecting line 12. The opening **4*a* is opened in a predetermined position of the piston 4** by the piston skirt to thereby establish the connection to the crankcase.

In the embodiment of FIG. 7, the return stroke of the pump piston 25 is reduced in dependence upon the underpressure in the air intake pipe. The underpressure in the air intake pipe 53 taken off in the flow direction behind the throttle flap 59 is switched to the intermediate volume 37 via the underpressure line 56 and a throttle 57. Air flows into the intermediate volume 37 from the atmosphere via the adjustable ventilating throttle 55. The adjustable throttle 55 is provided so that an underpressure in the intermediate volume 37 builds up with increasing rpm and is present via the line 35 as a counterpressure in the return chamber 23.

The piston skirt opens the connection **4*a* to the connecting line 12 in a predetermined position of the piston 4 and conducts the crankcase pressure to the pulse chamber 21 where the membrane 22 moves downwardly for pumping the fuel. With the subsequent upward movement of the pump piston 25 because of the return spring 30, the underpressure built up in the return chamber 23 effects a reduction of the return force so that the membrane 22** cannot travel back to its output position. In this way, the piston stroke is conditioned for a next injection operation less than with the previous injection operation. The pumped quantity of fuel is thereby less.

It can also be advantageous to configure the volumes which have previously been described as rigid, closed chambers. It is also advantageous to configure these volumes so as to be changeable such as in the form of a bellows.

It is understood that the foregoing description is that of the preferred embodiments of the invention and that various changes and modifications may be made thereto without departing from the spirit and scope of the invention as defined in the appended claims.

What is claimed is:

1. A fuel injection arrangement for a two-stroke engine, especially for handheld portable tools such as motor-driven saws or the like, the engine having a piston and a cylinder conjointly defining a combustion chamber and having a crankcase wherein pressure is developed in response to the movement of the piston, the fuel injection arrangement comprising:

an injection nozzle for injecting fuel into the combustion chamber;

a fuel injection pump including: a housing defining an enclosed work space; and, a membrane partitioning said work space into a pulse chamber and a return chamber;

a connecting line connecting said pulse chamber to the crankcase for charging said pulse chamber with the pressure present in the crankcase for actuating said membrane to develop an actuating force;

said fuel injection pump further including pumping means for pumping fuel to said nozzle, said pumping means including a piston operatively connected to said membrane so as to be reciprocally movable through a piston stroke; and, counterpressure means for generating a counterpressure in said return chamber for changing said piston stroke in dependence upon the rotational speed of the engine thereby changing the quantity of fuel pumped by said pumping means.

2. The fuel injection arrangement of claim 1, said counterpressure means comprising: adjusting volume means for receiving a flow of air; an adjusting line connecting said return chamber to said adjusting volume means; throttle means mounted in said adjusting line for throttling a rapid adjusting flow so as to permit a counterpressure to develop in said return chamber for acting counter to said force; a bypass connecting said return chamber to said adjusting volume means; and, a check valve mounted in said bypass so as to open toward said return chamber.

3. The fuel injection arrangement of claim 2, said counterpressure means comprising: an adjusting line connecting said return chamber to the atmosphere; throttle means mounted in said adjusting line for throttling a rapid adjusting flow so as to permit a counterpressure to develop in said return chamber for acting counter to said force; a bypass connecting said return chamber to the atmosphere; and, a check valve mounted in said bypass so as to open toward said return chamber.

4. The fuel injection arrangement of claim 2, said adjusting volume means being an enclosure connected to said adjusting line and defining a completely enclosed space.

5. The fuel injection arrangement of claim 2, said adjusting volume means being an enclosure connected to said adjusting line and defining a completely enclosed space; and, said enclosure including means for varying the volume of said space.

6. The fuel injection arrangement of claim 2, said counterpressure means comprising a check valve connected into said adjusting line so as to be serially connected with said throttle means and open toward said adjusting volume means.

7. The fuel injection arrangement of claim 2, said check valve being a threshold check valve opening in response to a predetermined threshold value.

8. The fuel injection arrangement of claim 2, said counterpressure means comprising a throttle connected into said bypass so as to be serially connected with said check valve.

9. The fuel injection arrangement of claim 2, said counterpressure means comprising a return chamber connecting line connecting said return chamber to the crankcase; and, a return chamber check valve connected into said return chamber connecting line so as to open toward the crankcase.

10. The fuel injection arrangement of claim 9, said return chamber connecting line being connected to said adjusting volume means so as to place the latter in series with said check valve.

11. The fuel injection arrangement of claim 9, said counterpressure means comprising a throttle connected into said return chamber connecting line so as to place the latter in series with said return chamber check valve.

12. The fuel injection arrangement of claim 9, said counterpressure means comprising a throttle for venting said return chamber to the atmosphere.

13. The fuel injection arrangement of claim 9, said adjusting volume means defining an enclosed space and being an enclosure connected to said adjusting line; said counterpressure means comprising a venting throttle for venting said enclosed space to the atmosphere.

14. The fuel injection arrangement of claim 13, a check valve connected in series with said venting throttle for blocking the flow therethrough in the flow direction toward the atmosphere.

15. The fuel injection arrangement of claim 13, said venting throttle including means for adjusting the flow therethrough.

16. The fuel injection arrangement of claim 15, said counterpressure means comprising control means for processing the operating characteristic quantities of the engine to adjust said venting throttle to adjust the flow therethrough.

17. The fuel injection arrangement of claim 9, said counterpressure means comprising: a check valve bypass connected in parallel to said return chamber check valve; and, a throttle connected into said check valve bypass for permitting slow adjusting flows therethrough.

18. The fuel injection arrangement of claim 17, said throttle connected into said check valve bypass including means for adjusting the flow therethrough.

19. The fuel injection arrangement of claim 18, said counterpressure means comprising control means for processing the operating characteristic quantities of the engine to adjust said throttle in said check valve bypass to adjust the flow therethrough.

20. The fuel injection arrangement of claim 2, said counterpressure means comprising a switchable valve means connected into said adjusting line, said switchable valve being actuable so as to open above a predetermined threshold value and to close below said threshold value.

21. The fuel injection arrangement of claim 20, said threshold value being a pressure threshold value.

22. The fuel injection arrangement of claim 21, said pressure threshold value being 0.2 bar.

23. The fuel injection arrangement of claim 1, the engine having an air-intake channel and said counterpressure means comprising an air-intake connecting line connecting said return chamber to said air-intake channel.

24. The fuel injection arrangement of claim 23, said counterpressure means further comprising an intermediate volume connected into said air-intake connecting line.

25. The fuel injection arrangement of claim 24, said counterpressure means comprising a throttle for venting said intermediate volume to the atmosphere.

26. The fuel injection arrangement of claim 2, said adjusting volume means being an enclosure connected to said adjusting line and defining an enclosed space; and, said counterpressure means further comprising: a storage volume; connecting means connecting said storage volume to said enclosure; an additional connecting line connecting said storage volume to the crankcase; and an additional check valve connected into said additional connecting line so as to open toward said storage volume; an additional bypass line connected across said additional check valve; and, an additional throttle connected into said additional bypass.

27. The fuel injection arrangement of claim 26, said additional throttle being an adjustable throttle.

28. The fuel injection arrangement of claim 26, said connecting means comprising: a connecting check valve connecting said enclosure and said storage volume so as to open toward said storage volume; and, a throttle connected between said enclosure and said storage volume so as to be in parallel with said connecting check valve.

* * * * *

UNITED STATES PATENT AND TRADEMARK OFFICE

CERTIFICATE OF CORRECTION

PATENT NO. : 4,807,573

DATED : February 28, 1989

INVENTOR(S) : R. Schierling, W. Geyer, M. Wissmann and H. Nickel

It is certified that error appears in the above-identified patent and that said Letters Patent is hereby corrected as shown below:

On the front page, under "References Cited", namely, Borst et al: delete "427/395" and substitute -- 417/395 -- therefor.

In column 2, line 46: delete "i" and substitute -- is -- therefor.

In column 7, line 46: delete "o" and substitute -- to -- therefor.

Signed and Sealed this

Nineteenth Day of September, 1989

*Attest:*

*Attesting Officer*

DONALD J. QUIGG

*Commissioner of Patents and Trademarks*